US011879298B2

(12) United States Patent
Beach et al.

(10) Patent No.: US 11,879,298 B2
(45) Date of Patent: Jan. 23, 2024

(54) DRIVE SUB FOR A DRILLING ASSEMBLY

(71) Applicant: REFLEX INSTRUMENTS ASIA PACIFIC PTY LTD, Balcatta (AU)

(72) Inventors: Andrew Phillip Beach, Balcatta (AU); Amir Mokaramian, Balcatta (AU)

(73) Assignee: REFLEX INSTRUMENTS ASIA PACIFIC PTY LIMITED, Balcatta (AU)

( * ) Notice: Subject to any disclaimer, the term of this patent is extended or adjusted under 35 U.S.C. 154(b) by 16 days.

(21) Appl. No.: 17/638,003

(22) PCT Filed: Aug. 27, 2020

(86) PCT No.: PCT/AU2020/050894
§ 371 (c)(1),
(2) Date: Feb. 24, 2022

(87) PCT Pub. No.: WO2021/035299
PCT Pub. Date: Mar. 4, 2021

(65) Prior Publication Data

US 2022/0275688 A1 Sep. 1, 2022

(30) Foreign Application Priority Data

Aug. 27, 2019 (AU) ..... 2019903131

(51) Int. Cl.
*E21B 17/046* (2006.01)
*E21B 21/00* (2006.01)
(Continued)

(52) U.S. Cl.
CPC ..... *E21B 17/0465* (2020.05); *E21B 10/64* (2013.01); *E21B 21/00* (2013.01); *E21B 17/1085* (2013.01)

(58) Field of Classification Search
CPC ..... E21B 17/0465; E21B 10/64; E21B 21/00; E21B 17/1085; E21B 17/1078; E21B 17/18; E21B 21/12; E21B 23/00
See application file for complete search history.

(56) References Cited

U.S. PATENT DOCUMENTS 2,560,328 A * 7/1951 Bielstein ..... E21B 12/02 175/242
4,708,496 A * 11/1987 McPherson ..... F16C 33/108 228/122.1
(Continued)

FOREIGN PATENT DOCUMENTS

EP 3214259 A1 9/2017
WO 2019/068145 A1 4/2019

OTHER PUBLICATIONS

Australian Patent Office, International Search Report issued in corresponding Application No. PCT/AU2020/050894, dated Oct. 23, 2020.

*Primary Examiner* — Jonathan Malikasim
(74) *Attorney, Agent, or Firm* — Stites & Harbison, PLLC; Terry L. Wright

(57) ABSTRACT

A drive sub for a drilling assembly includes a tubular body configured to receive and releasably engage a drilling tool. The body has inner and outer faces and further has a castellated edge provided on its operative downhole end, which edge defines a plurality of lugs separated from each other by intervening slots. In one aspect the drive sub has a contour profile provided at least partially along a circumference of the castellated edge, wherein the contour profile traverses the castellated edge substantially from the inner face to the outer face. In another aspect the drive sub has a channel provided in each of the lugs, wherein the channel at least partially traverses the lugs and leads from an inlet opening on the castellated edge to an outlet opening on the
(Continued)

outer face. The contour profile and/or channel facilitate flow of drilling fluid and cuttings past the lugs during use.

19 Claims, 8 Drawing Sheets

(51) Int. Cl.
*E21B 10/64* (2006.01)
*E21B 17/10* (2006.01)

(56) References Cited

U.S. PATENT DOCUMENTS

| | | | | |
|---|---|---|---|---|
| 7,296,639 | B2 * | 11/2007 | Millar | E21B 7/061 175/57 |
| 11,041,352 | B2 * | 6/2021 | Ferguson | E21B 23/14 |
| 2016/0290067 | A1 * | 10/2016 | Tipples | E21B 17/1078 |

* cited by examiner

DRIVE SUB FOR A DRILLING ASSEMBLY

TECHNICAL FIELD

The present disclosure relates to a drive sub for a drilling assembly.

More particularly, the present disclosure relates to a drive sub for a drilling assembly configured to facilitate uphole flow of drilling fluid and cuttings past a downhole end of the drive sub.

BACKGROUND

In core drilling operations a drill bit is disposed at the end of a drill string comprising multiple drill rods. In some drilling operations, when the drill bit becomes worn and needs replacement, it is necessary to withdraw the drill string from its borehole until the drill bit has been reached. This is commonly known as "tripping" the drill string. Tripping the drill string is also required for other purposes, such as to replace reamer pads or to attach other drilling equipment to the downhole end of the drill string. Tripping the drill string tends to be very time-consuming and labour intensive, especially when drilling deep holes.

Various alternatives have been proposed to overcome the need to trip the drill string by providing retractable drill bit systems. Examples of such systems are known from U.S. Pat. Nos. 3,955,633, 6,155,360 and WO 2019/068145.

WO 2019/068145 discloses a downhole delivery system that comprises a drive sub attached to a drill string, wherein the drive sub is configured to receive and lockingly engage with a tool, with the tool typically carrying a drill bit at its downhole terminal end. The drive sub is substantially a tubular body defining a central passage through which the tool extends. The drive sub has a castellated lower edge in which there are provided a plurality of equally spaced lugs separated from each other by intervening slots. The slots receive and engage locking members that project outwardly from the tool with the locking members carrying reamer pads. In use, a borehole drilled using this downhole delivery system displays a step change in its diameter, wherein the drill bit on the tool drills a hole having a first diameter and which hole is subsequently enlarged to a second diameter by the reamer pads on the locking members.

A problem that may be encountered is that the lower edge of the lugs (i.e. the axial face of the drive sub directed downhole) of the drive sub shown in WO 2019/068145 is in the shape of a perpendicular radial wall surrounding the tool, which radial wall forms a circumferential step that can hinder the flow drill cuttings past the drive sub in an uphole direction. This often results in the cuttings becoming trapped against a locking member/reamer pad in the circumferential corner formed by the tool and the axial face of the drive sub. If drilling is subsequently continued, the cuttings may form an abrasive band and cause excessive wearing of one or both the drive sub and/or the tool thereby shortening the operative life.

Further, in some instances when the tool is delivered to and received within the drive sub shown in WO 2019/068145, the locking members may fail to align properly with the intervening slots thereby preventing, in whole or in part, the locking members from latching between the lugs. For example, this may occur if mud sediment packs onto the tool key so that the key is not able to travel fully into its socket. In such cases the tool is withdrawn to the surface for inspection and repair before again being lowered to the drive sub. Sometimes operational rotation of the drill string is restarted before a driller becomes aware that the tool has not properly latched to the drive sub—this can cause damage to the downhole face of the drive sub because it is not 'protected' by the reamer pads projecting downhole thereof, i.e. the drive sub impacts onto the ledge present in the borehole caused by the step change in the borehole diameter.

It is to be understood that, if any prior art publication is referred to herein, such reference does not constitute an admission that the publication forms a part of the common general knowledge in the art, in Australia or any other country.

SUMMARY OF THE DISCLOSURE

According to a first aspect of the disclosure, there is provided a drive sub for a drilling assembly, the drive sub comprising

- a tubular body configured to receive and releasably engage a tool, the body having an inner face and an outer face;
- a castellated edge provided at an operative downhole end of the body, the castellated edge defining a plurality of lugs separated from each other by intervening slots; and
- a contour profile provided at least partially along a circumference of the castellated edge, the contour profile traversing the castellated edge substantially from the inner face to the outer face, wherein the contour profile is configured to facilitate flow of drilling fluid and cuttings past the lugs during use.

According to a second aspect of the disclosure, there is provided a drive sub for a drilling assembly, the drive sub comprising

- a tubular body configured to receive and releasably engage a tool, the body having an inner face and an outer face;
- a castellated edge provided at an operative downhole end of the body, the castellated edge defining a plurality of lugs separated from each other by intervening slots; and
- a channel provided in each of the lugs, the channel at least partially traversing the lugs and leading from an inlet opening on the castellated edge to an outlet opening on the outer face.

The contour profile may be disposed on the lugs to form a radial ramp being configured in use to deflect flow of drilling fluid and cuttings from a vicinity near the inner face towards the outer face. In one embodiment the contour profile is a chamfer face between the castellated edge and the outer face and optionally further having respective fillets between the chamfer face and the inner face and between the chamfer face and the outer face. In another embodiment the contour profile is a bevelled face extending from the inner face to the outer face.

The contour profile may include a circumferential recess in the outer face, wherein the recess is disposed in a region of the outer face located operatively uphole of the lugs. The recess may be substantially non-symmetrically V-shaped in cross-sectional side view having a downhole radial wall and an uphole radial wall, wherein the downhole radial wall has a greater transverse inclination than the uphole radial wall.

During use the contour profile may be configured to cooperate with a borehole sidewall to define a venturi formation adjacent the body, the venturi formation being adapted to cause increased flow rates in drilling fluid as it flows axially over the contour profile between the body and the borehole sidewall.

Each of the lugs may include a channel at least partially traversing the contour profile. Furthermore, each lug has a leading part and a trailing part with reference to a direction of rotation of the body during use. In one embodiment the leading part of each lug is configured to provide support to a locking member located in a slot adjacent the leading part. For this reason the channel is located substantially in the trailing part. Each channel may be contiguous with a slot adjacent the trailing part.

In one embodiment each channel is open to the outer face along a full extent of the channel and the channel extends at its downhole end from substantially near to the inner face and leads at its uphole end onto the outer face of the body.

In one embodiment each channel comprises a tunnel extending through its lug having a tunnel inlet in the castellated edge substantially near to the inner face and a tunnel outlet on the outer face of the body uphole of its lug.

In one embodiment each channel includes a tunnel extending through the body having a tunnel inlet on the inner face uphole of the castellated edge and a tunnel outlet on the outer face of the body up hole of its lug. Each channel may include a tunnel for an uphole part of its length, while a downhole part of the length of the channel is open to the inner face of the body with the channel having an inlet opening in the castellated edge.

The drive sub may include wear-resistant members mounted on the lugs. The wear-resistant members may be polycrystalline diamond buttons and/or blades mounted in recesses, which recesses are selectively provided to the lugs, or to the castellated edge, or to a downhole facing part of the contour profile.

In on embodiment the drive sub may comprise a wear-resistant coating provided on the lugs.

According to a third aspect of the disclosure, there is provided a drilling assembly comprising

- a drive sub as described according to either the first or second aspect of the disclosure; and
- a tool supported by the drive sub, the tool comprising one or more gullies in its outer circumference, wherein the gullies are configured to selectively cooperate with either one of or both the contour profile and the channel to respectively direct flow of drilling fluid over the contour profile or into the channel and thereby assist in facilitating flow of drilling fluid and cuttings past the lugs during use.

BRIEF DESCRIPTION OF DRAWINGS

The above and other features will become more apparent from the following description and with reference to the accompanying schematic drawings. In the drawings, which are given for purpose of illustration only and are not intended to be in any way limiting, there is shown in.

DETAILED DESCRIPTION

The present disclosure relates to a drilling assembly 10 used in a drilling operation and particularly to a drive sub 12 forming part of the drilling assembly 10. In some instances the drive sub 12 is also referred to in the industry as a mule shoe. It will be appreciated that the drilling assembly 10 can comprise a multitude of various other parts but, for the purposes of this disclosure, only the relevant parts of the drilling assembly 10 will be described. The drive sub 12 is configured to receive and releasably engage a tool 14. In normal use, the drive sub 12 will be attached to an end of a drill string (not shown) disposed in a borehole, which drill string typically comprises a number of drill pipes joined end to end.

Figure 2:
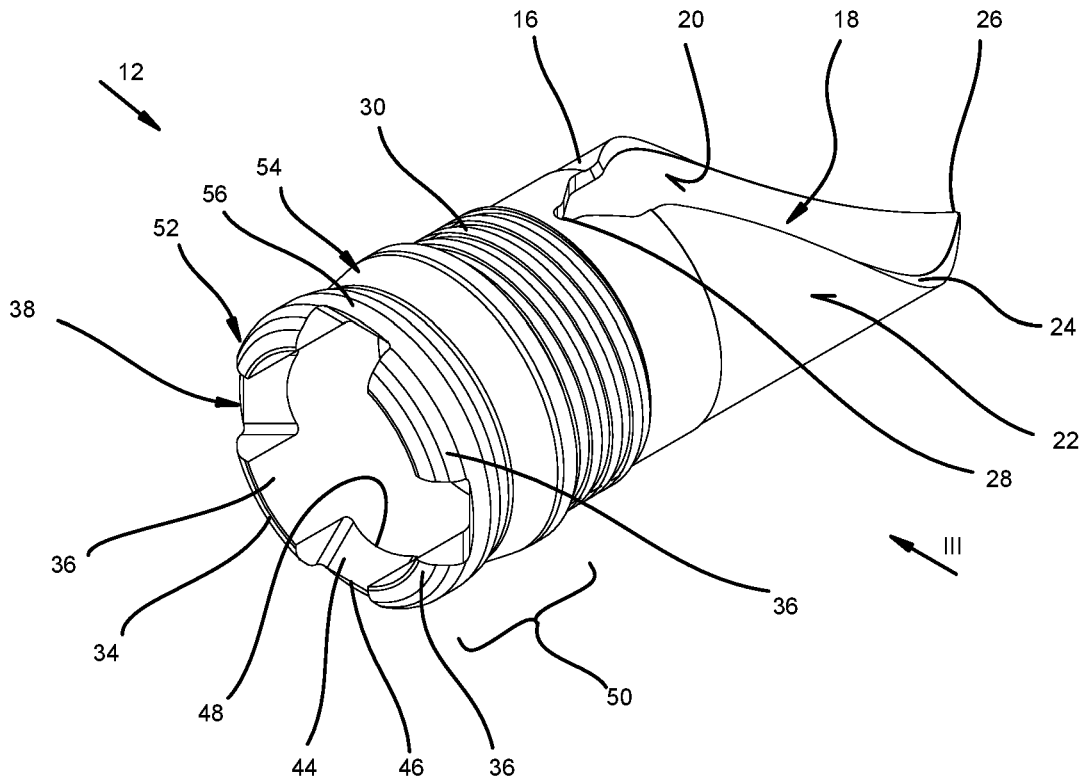
FIG. 2 is a perspective view of a first embodiment of the drive sub.
Figure 3:
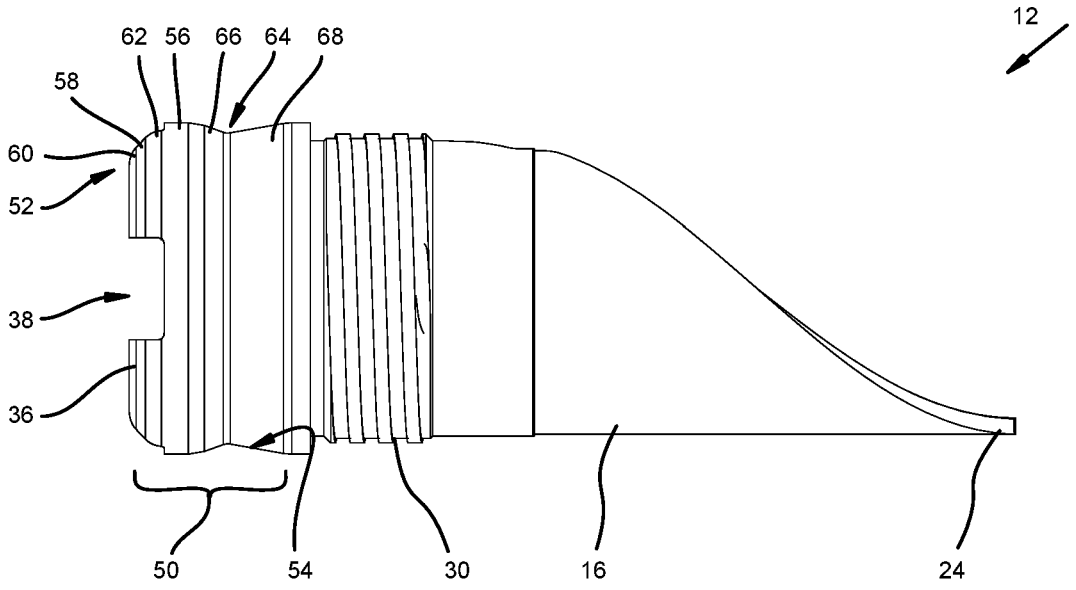
FIG. 3 is a side view of the first embodiment of the drive sub seen along arrow III in FIG. 2.

As is more clearly shown in FIGS. 2 and 3, there is shown a first embodiment of the drive sub 12 which includes a substantially tubular body 16 defining a central passage 18. The body 16 has an inner face 20 and an outer face 22.

The drive sub 12 has a curved uphole guide edge 24 that leads from an uphole peak 26 to a socket 28, wherein the guide edge 24 is configured to rotationally align the tool 14 with the drive sub 12 when the tool 14 is passed through the passage 18. In this regard a key 29 (see FIG. 11) protrudes from the tool 14 so that the key 29 can abut and run along the guide edge 24 until it becomes seated in the socket 28. The drive sub 12 is formed with a screw thread 30 on its outer face 22 for connecting the drive sub 12 to other parts of the drilling assembly, e.g. to the drill string or to a reamer sub 32.

The drive sub 12 has a castellated edge 34 provided at an operative downhole end of the body 16, the edge 34 being formed by a plurality of equally spaced lugs 36 separated from each other by intervening recesses or slots 38. The exemplary embodiment of the drive sub 12 is shown having four lugs 36 being orthogonally spaced from each other on the edge 34 and correspondingly four slots 38 located between the lugs 36.

The slots 38 are configured to receive and engage locking members 40 (shown in FIG. 1) that are carried by and project outwardly from the tool 14. In one embodiment the locking members 40 include reamer pads 42 extending axially downhole from the locking members 40 and which reamer pads 42 project axially downhole beyond the drive sub 12 so that the reamer pads 42 can perform a drilling operation on the borehole sidewall. The slots 38 have tapered faces 44 that reduce in inner diameter in a direction from a downhole end 46 of each tapered face 44 to an uphole end 48 thereof. The downhole end 46 lies on the outer face 22 of the body 16 while the uphole end 48 lies on the inner face 20 of the body 16. The tapered faces 44 provide a ramp along which the locking members 40 can ride as they engage with or disengage from the slots 38, i.e. thereby locking or releasing the tool 14 from the drive sub 12.

The drive sub 12 has a contour profile 50 provided at least partially along a circumference of the edge 34 with the contour profile 50 traversing the edge 34 substantially from the inner face 20 towards the outer face 22. In the exemplary embodiment the contour profile 50 runs onto the outer face 22 and terminates short of the screw thread 30. The contour profile 50 functions to facilitate fluid flow past the lugs 36 during use so that cuttings can be exhausted from the borehole without being trapped by the edge 34. The contour profile 50 comprises two main parts wherein a first part 52 thereof is disposed on the lugs 36 and a second part 54 thereof is disposed in a region of the outer face 22 located uphole of the lugs 36. The first part 52 is separated from the second part 54 by a circumferential shoulder or collar 56.

In an alternative embodiment (not shown) the contour profile 50 can only comprise the first part 52.

The first part 52 includes a chamfer face 58 between the edge 34 and the outer face 22, i.e. leading onto the collar 56. In the exemplary embodiment the chamfer is shown orientated at an enclosed angle of about 45° relative to the rotational axis of the drive sub 12. However, it should be appreciated that the chamfer face 58 can be provided at any desired angle between about 35° to 55° relative to the rotational axis of the drive sub 12. The first part 52 further includes fillet faces 60, 62 along the opposed sides of the chamfer face 58, i.e. an inner fillet face 60 between the chamfer face 58 and the inner face 20 as well as an outer fillet face 62 between the chamfer face 58 and the outer face 22.

In an alternative embodiment, the first part 52 can include a bevelled face extending fully from the inner face 20 to the outer face 22, i.e. to the collar 56, wherein the bevelled face is provided at any desired angle between about 35° to 55° relative to the rotational axis of the drive sub 12, for example the bevelled face being provided at 45°.

It will be appreciated that the first part 52 functions to interrupt the edge 34, i.e. breaking the perpendicular wall extending radially outwardly from the tool 14, by forming a radial ramp configured in use to deflect flow of drilling fluid and cuttings from a vicinity adjacent the tool 14 downhole of the edge 34 towards the outer face 22. This reduces the prevalence of drill cuttings becoming trapped and accumulating in corners formed by the tool 14, the edge 34 and the locking members 40/reamer pads 42.

The second part 54 includes a circumferential recess 64 in the outer face 22, wherein the recess 64 is disposed in a region of the outer face 22 located operatively uphole of the lugs 36. The recess 64 is substantially non-symmetrically V-shaped in cross-sectional side view being formed by a relatively sharply sloping downhole radial wall 66 and a relatively shallow sloping uphole radial wall 68. In the exemplary embodiment the downhole radial wall 66 is angled at an enclosed angle of about 20° relative to the outer face 22, whereas the uphole radial wall 68 is angled at an enclosed angle of about 5° relative to the outer face 22.

Figure 6:
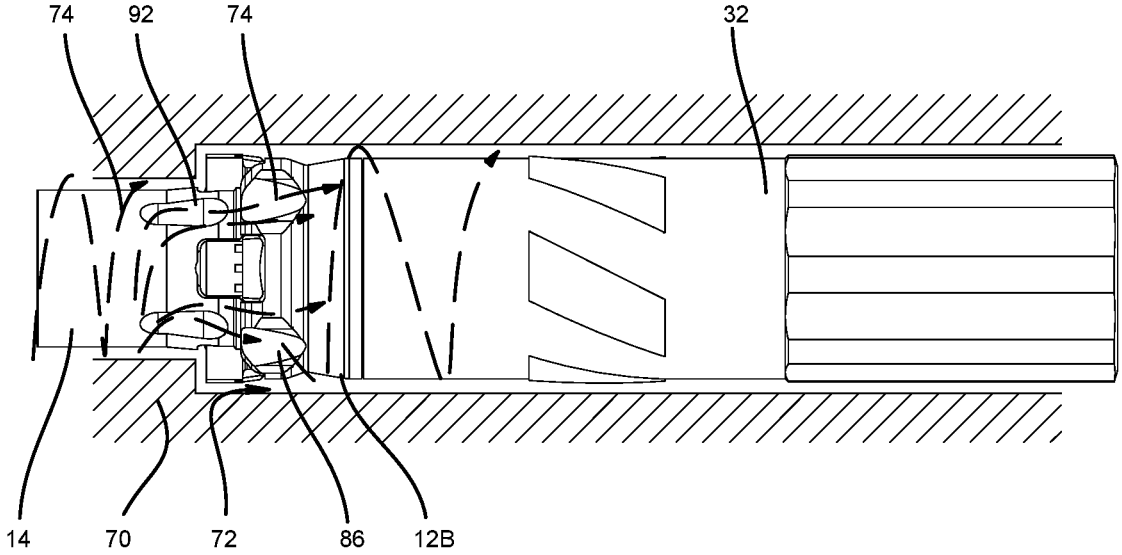
FIG. 6 is a side view of a drilling assembly provided with the drive sub of FIGS. 4 and 5, shown in an operative position during use within a borehole.

As is shown in FIG. 6, it will be appreciated that, in use, the first part 52, collar 56 and second part 54 cooperate with a borehole sidewall 70 to create a venturi formation wherein a narrow throat 72 is formed between the collar 56 and the sidewall 70. The venturi formation causes increased flow rates in drilling fluid as it passes through the throat 72 to assist in drawing cuttings past the edge 34. The general flow direction of the drilling fluid is indicated by dashed arrows 74.

Figure 1:
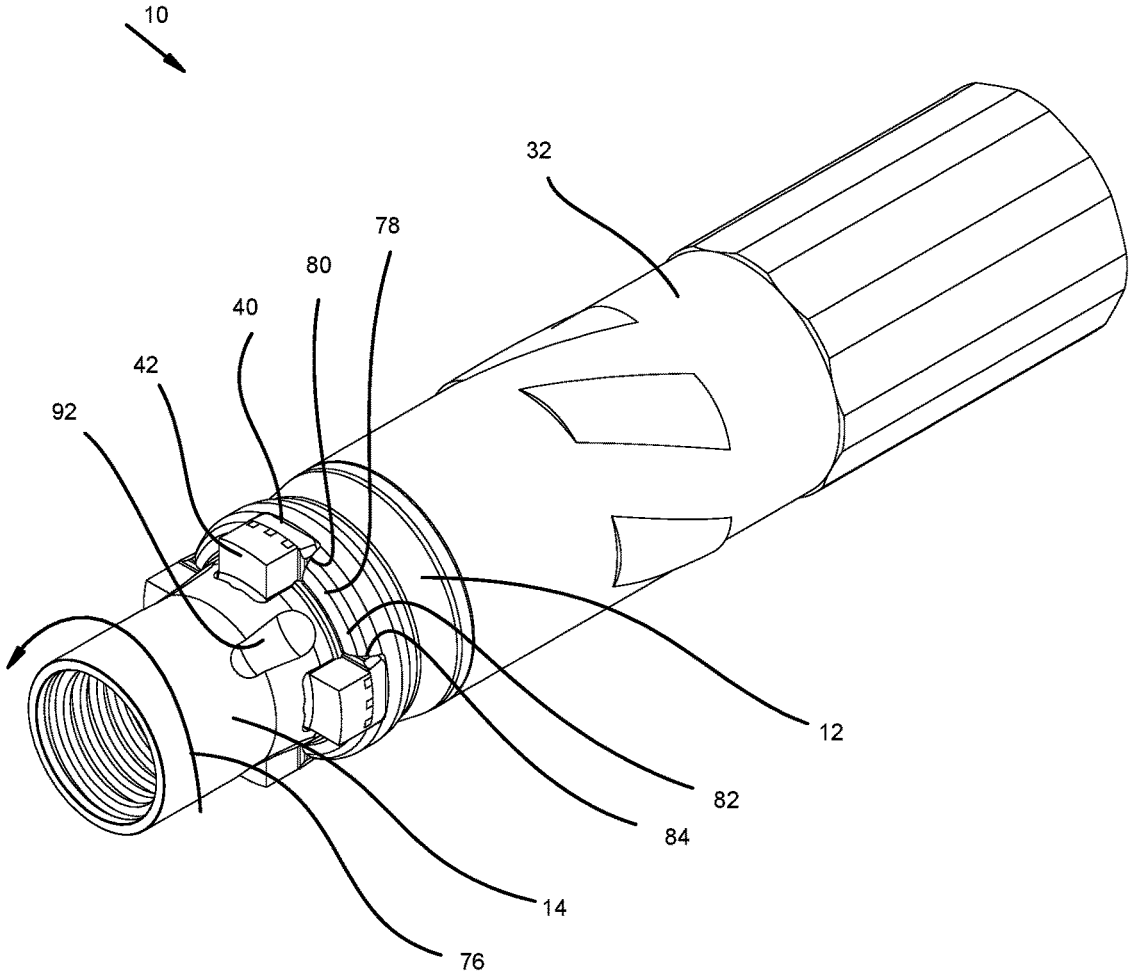
FIG. 1 is a perspective view of a portion of a drilling assembly showing a drive sub drive sub engaging a tool

In use, the drive sub 12 will normally rotate axially in a clockwise direction when looking from an uphole end towards a downhole end thereof, namely in the direction indicated by arrow 76 (FIG. 1). Each lug 36 will therefore have a rotationally leading part 78 adjacent a leading edge 80 thereof and a rotationally trailing part 82 adjacent a trailing edge 84. The lugs 36 are configured to provide buttressing support to the locking members 40 to absorb opposing torque applied by the borehole sidewall 70 during drilling by the reamer pads 42. The highest level of opposing torque is encountered in the leading part 78 of the lugs 36 and therefore the design of the contour profile 50 is configured so that the leading part 78 of the lugs 36 is able to provide the desired buttressing support. For example, in typical drilling conditions the reamer pads 42 and/or locking members 40 will encounter stress forces in the range of 500-1500 MPa and accordingly the lugs 36, or at least their leading parts 78, must be able to provide buttressing support of at least 1500 MPa to the locking members 40.

It is envisaged that the first part 52 of the contour profile 50 need not necessarily extend circumferentially around the drive sub 12 as shown in the drawings. The first part 52 can extend along only a part of each lug 36, i.e. wherein a leading part 78 of the lug 36 retains its "square" profile (similar to that shown in FIGS. 7 and 8), while the trailing part 82 of the lug 36 exhibits the first part 52 of the contour profile 50 (similar to that shown in FIGS. 2 and 3). In this way the lugs 36 can provide improved support to the locking members 40 during operative drilling conditions.

Figure 4:
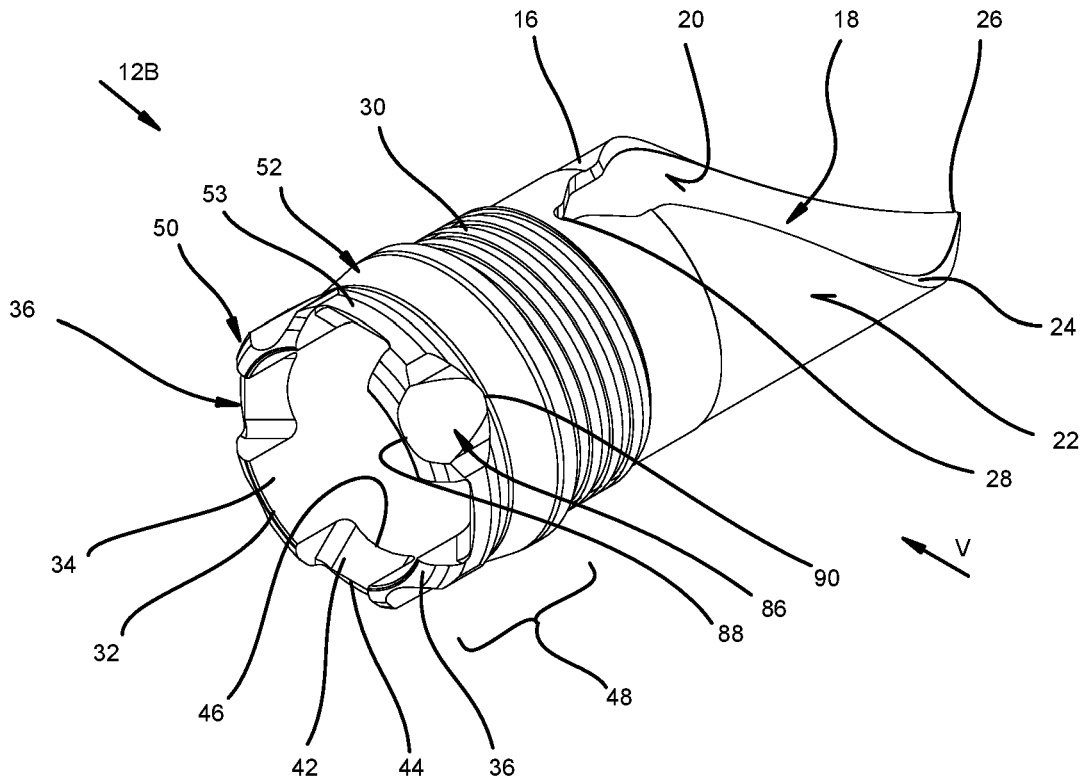
FIG. 4 is a perspective view of a second embodiment of the drive sub.
Figure 5:
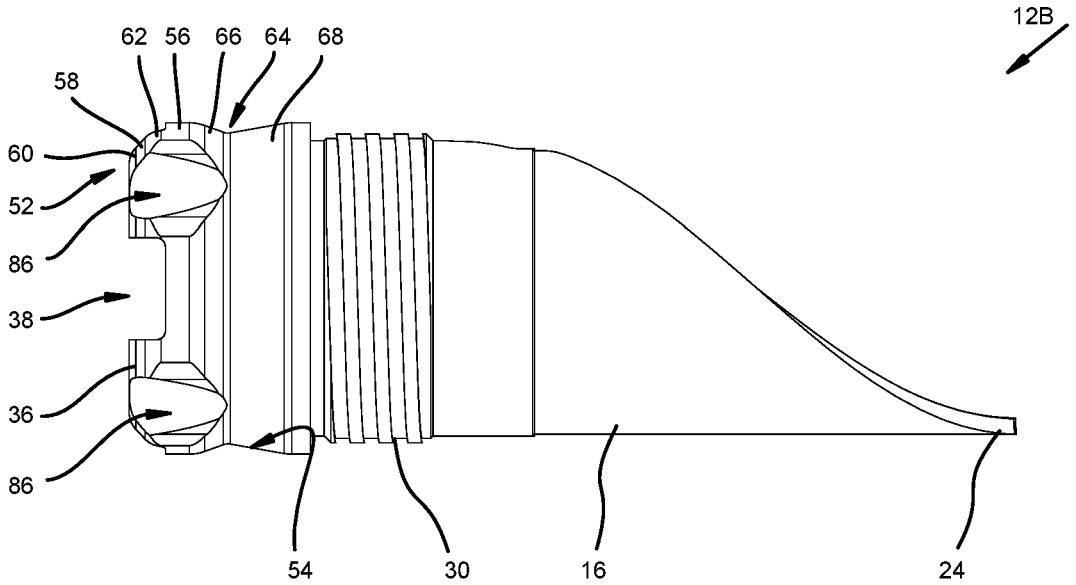
FIG. 5 is a side view of the second embodiment of the drive sub seen along arrow V in FIG. 4.

Referring now to FIGS. 4 and 5, there is shown a second embodiment of a drive sub 12B. The drive sub 12B is substantially similar to the drive sub 12 and thus the same parts will be identified using the same reference numerals. The drive sub 12B differs from the drive sub 12 in that each of the lugs 36 in the drive sub 12B is further provided with a channel 86 extending through the contour profile 50.

Each channel 86 has in inlet opening 88 leading from the edge 34 (or at least from the first part 52) and an outlet opening 90 exiting on the outer face 22 (or at least beyond the collar 56 within the recess 64). The channels 86 are configured to function as outwardly directed ramps in an uphole direction leading from the inner face 20 of the drive sub 12 to its outer face 22, thereby to further facilitate fluid flow past the edge 34 during use.

Each channel 86 is fully or mainly located in the central or trailing part 82 of its lug 36 to avoid reducing the buttressing support provided by the lug 36 to a locating member 40 adjacent to its leading edge 80. Optionally, but not necessarily, the channel 86 is contiguous with the trailing edge 84 so that the channel 86 runs into the slot 38 adjacent the trailing edge 84.

In one embodiment the channels 86 have a regular cross-section when seen from the end view along the axis of rotation of the drive sub 12. In another embodiment the channels 86 are divergent along their length having smaller inlet openings 88 at their downhole ends and larger outlet openings 90. In yet another embodiment the channels 86 are convergent along their length having larger inlet openings 88 at their downhole ends and smaller outlet openings 90.

In one embodiment the channels 86 extend in a longitudinal direction that is aligned with and substantially parallel to the axis of rotation of the drive sub 12. In another embodiment the channels 86 are inclined/slanted relative to the axis of rotation of the drive sub 12 so that the channels 86 extend in an axial direction that is angled operatively rearward, i.e. wherein each channel 86 has its outlet opening 90 located further towards or beyond the trailing edge 84 of its lug 36. In another embodiment the channels 86 are inclined/slanted in an axial direction that is angled operatively forward, i.e. wherein each channel 86 has its outlet opening 90 located further towards or beyond the leading edge 80 of its lug 36. When slanted channels 86 are provided, the channels 86 are preferably located in a central or rotationally trailing part of their lugs 36 but are not provided in a rotationally leading part of the lugs 36—thereby the lugs 36 are still able to provide the requisite buttressing support to a locating member 40 adjacent to its leading edge 80

It is considered that channels 86 that converge along their length, i.e. having a larger inlet opening 88 and smaller outlet opening 90, provide the advantage that more drilling fluid and entrained cuttings can be captured thereby. Additionally, in some embodiments, the smaller outlet opening 90 that opens into the recess 64, results in the channel 86 causing a venturi effect to improve flow rates of the drilling fluid through the channel 86. It is also considered that rearwardly inclined channels 86 provide the further advantage of acting as an impeller to force drilling fluid to pass through the channels 86.

Referring to FIGS. 1 and 6, the tool 14 can optionally comprise one or more gullies 92 in its outer circumference, wherein the gullies 92 are configured to cooperate with the contour profile 50 and/or the channels 86 to assist in facilitating flow of drilling fluid and cuttings past the lugs 36 during use. The gullies 92 operate to pre-direct flow of fluid flowing axially along the tool 14 so that it more readily flows onto and over the contour profile 50 or into the channels 86.

Although there will be a high degree of turbulence in the drilling fluid in the vicinity of the drive sub 12, when following the flow of drilling fluid in an uphole direction (as indicated by dashed arrows 74 in FIG. 6), the flow occurs roughly spirally in a clockwise direction around the tool 14 due to the stirring motion caused by operative drilling rotation of the tool 14. The flow then becomes more axial as it flows over the contour profile 50 and/or through the channels 86, whereafter the flow again becomes roughly spiral in a clockwise direction around the reamer sub 32 due to the stirring motion thereof.

Figure 7:
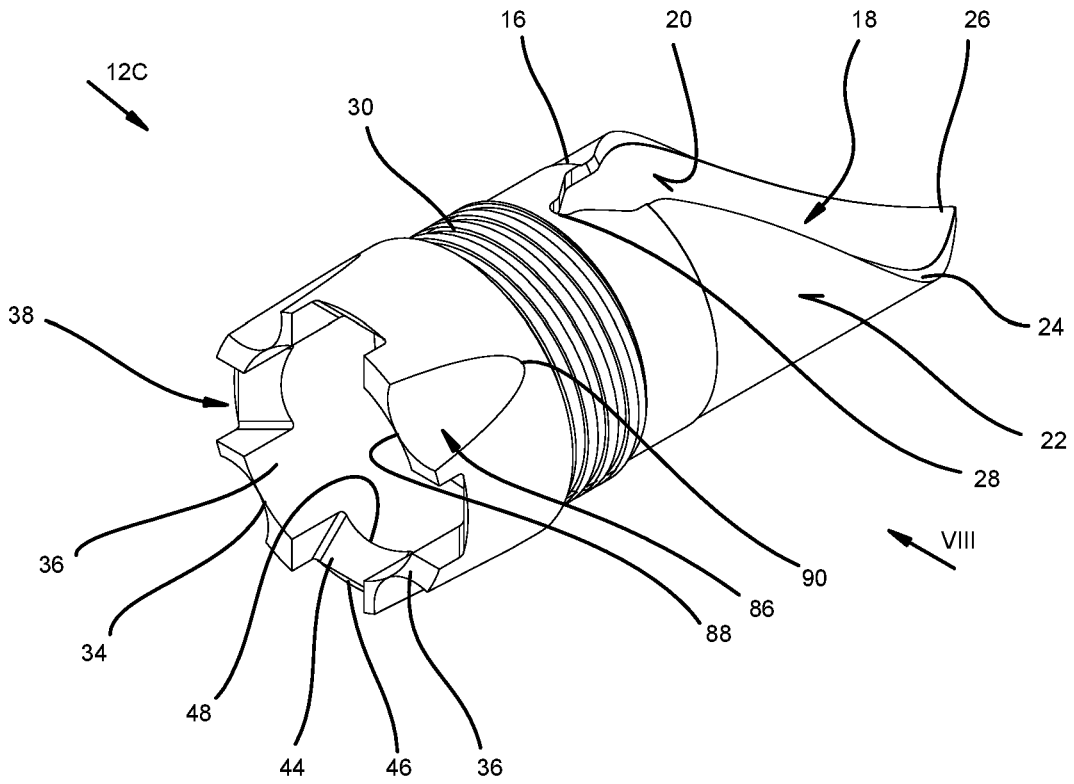
FIG. 7 is a perspective view of a third embodiment of the drive sub.
Figure 8:
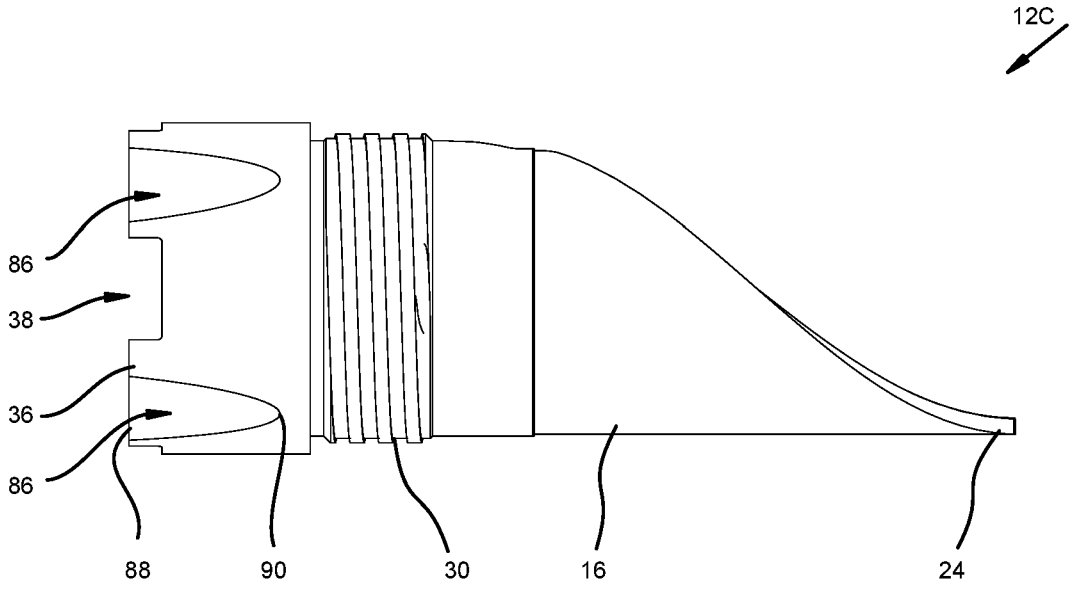
FIG. 8 is a side view of the third embodiment of the drive sub seen along arrow VII in FIG. 7.

Referring now to FIGS. 7 and 8, there is shown a third embodiment of a drive sub 12C. The drive sub 12C is roughly similar to the drive subs 12 and 12B and thus the same parts will be identified using the same reference numerals. The drive sub 12C is similar to the drive sub 12B in that it is also provided with channels 86 in its lugs 36, each channel 86 having inlet opening 88 leading from the edge 34 and an outlet opening 90 exiting on the outer face 22. The drive sub 12C differs from drive sub 12B in that it does not display the contour profile 50 provided on drive sub 12. Accordingly the drive sub 12C has the outlet opening 90 of its channel 86 located on the outer face 22 of the body 16.

In use, the cuttings entrained in the drilling fluid will largely flow through the channel 86 to traverse the edge 34. In some cases the cuttings may initially gather against the square-shaped profile of the leading part 78 of the lug, but as the drive sub 12C is further operatively rotated the cuttings will encounter the channel 86 to then be exhausted from the edge 34.

Figure 9:
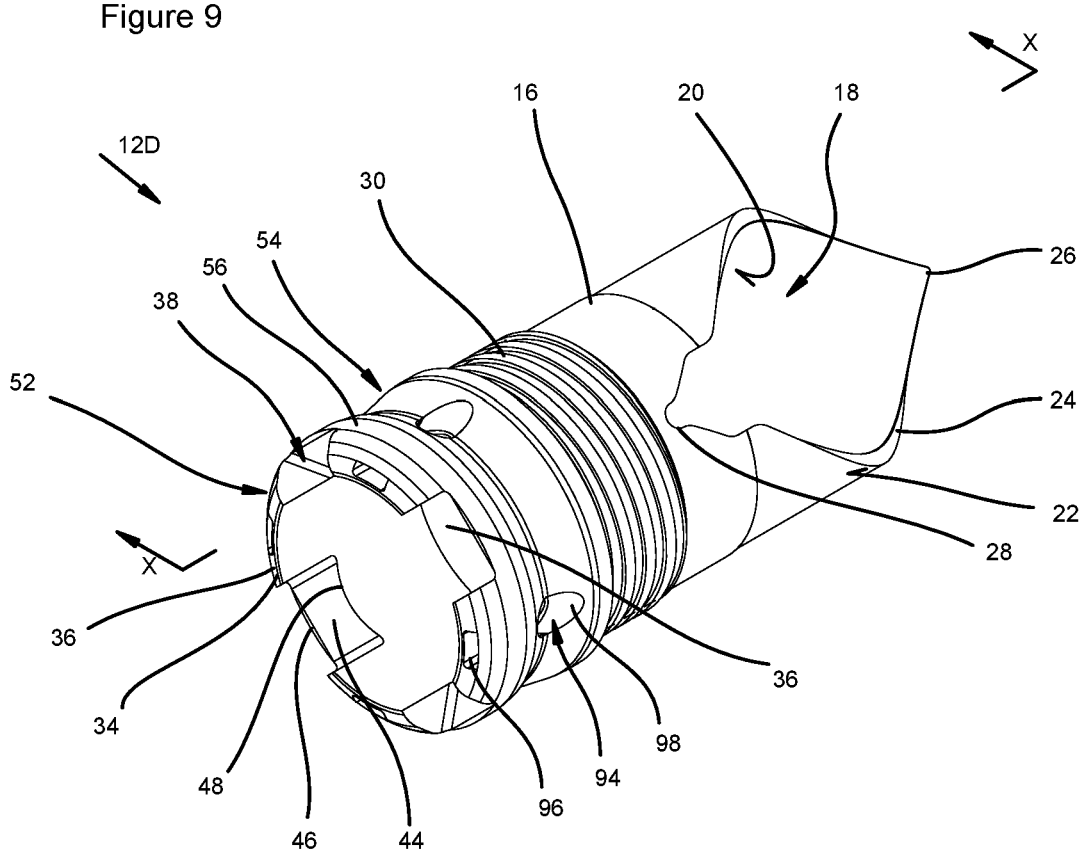
FIG. 9 is a perspective view of a fourth embodiment of a drive sub.
Figure 10:
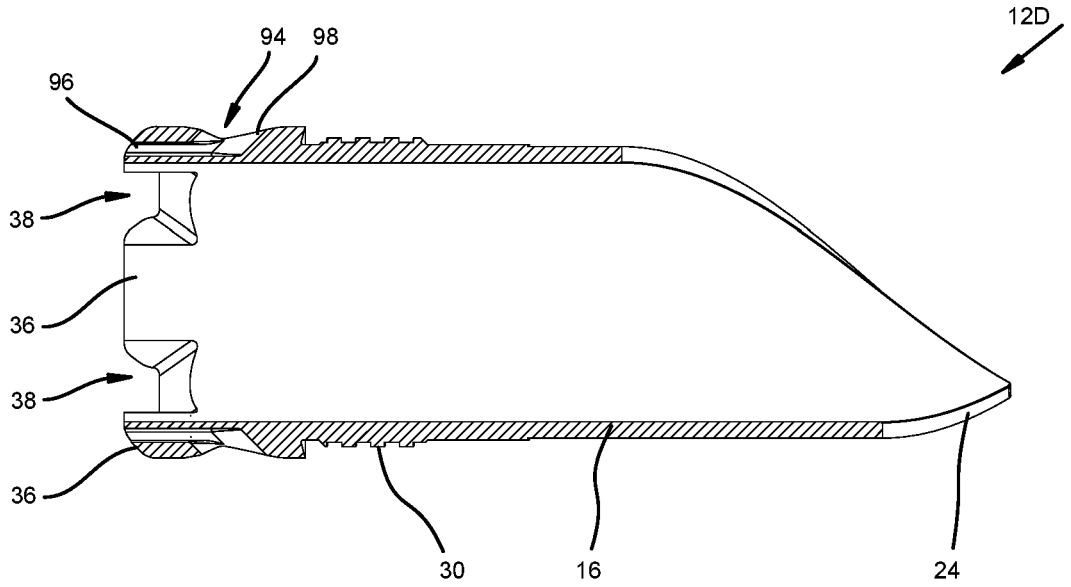
FIG. 10 is a sectional side view of the fourth embodiment of the drive sub seen along arrows X-X in FIG. 9.

FIGS. 9 and 10 show a fourth embodiment of a drive sub 12D, again being substantially similar to the drive sub 12 and thus the same parts will be identified using the same reference numerals. Drive sub 12D includes a bypass tunnel 94 extending through each lug 36 and having a tunnel inlet 96 leading from the edge 34 (or at least from the first part 52 of the contour profile 50) and a tunnel outlet 98 exiting on the outer face 22 (or at least beyond the collar 56 within the recess 64). Each tunnel 94 is configured to function as an outwardly directed ramp in an uphole direction to facilitate fluid flow past the edge 34 during use. Similar to the channel 86 displayed in drive subs 12B and 12C, also the tunnel 94 can be regular, convergent or divergent along its length as well as being selectively orientated parallel or inclined forward or rearward relative to the axis of rotation of the drive sub 12D.

Figure 11:
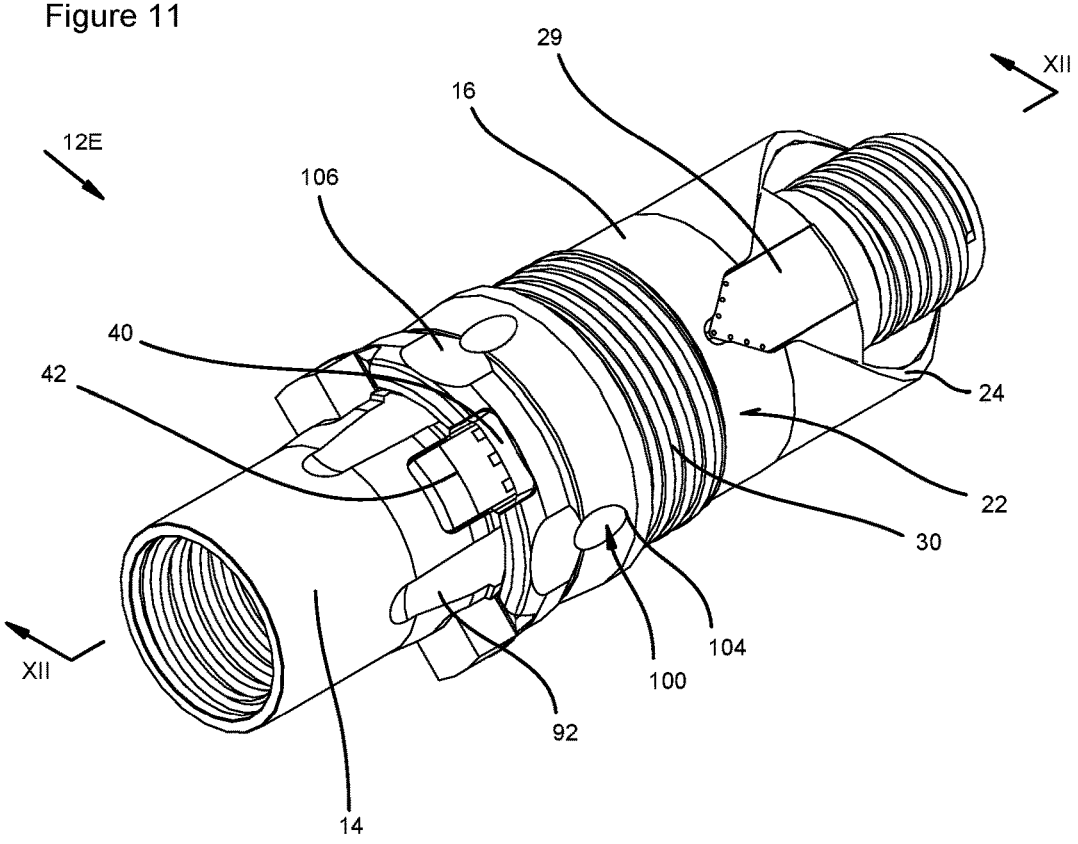
FIG. 11 is a perspective view of a portion of a drilling assembly showing a fifth embodiment of the drive sub engaging a further embodiment of the tool.
Figure 12:
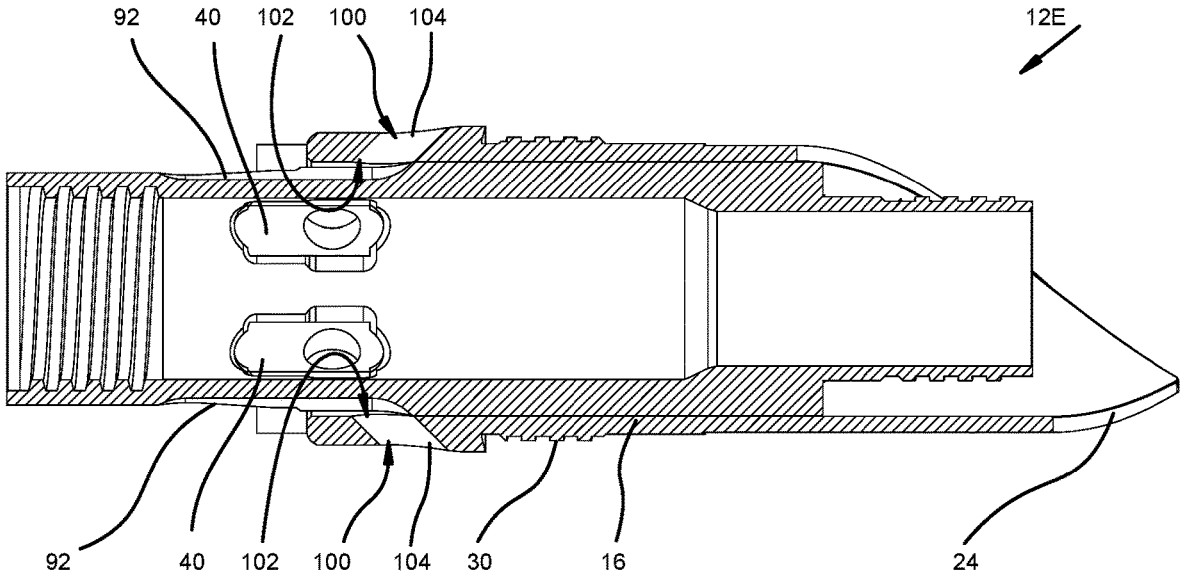
FIG. 12 is a sectional side view of the drilling assembly shown in FIG. 11 seen along arrows XII-XII in FIG. 11.

FIGS. 11 and 12 show a fifth embodiment of a drive sub 12E, again being substantially similar to the drive sub 12 and thus using the same reference numerals to identify the same parts. Drive sub 12E includes a transverse tunnel 100 extending through the body 16 and having a tunnel inlet 102 leading from its inner face 20 and a tunnel outlet 104 exiting on the outer face 22 (or at least beyond the collar 56 within the recess 64). In this embodiment the gullies 92 on tool 14 are extended axially so as to extend from a vicinity downhole of the edge 32 passing beneath the lugs 36 until the gullies 92 are in flow communication with their respective tunnels 100.

In an alternative embodiment being equivalent to drive sub 12E, the tunnel 100 can lead into and be in fluid flow communication with an axial channel extending along the inner face 20 and having an inlet opening on the edge 32.

Drive sub 12E shows circumferential flat faces 106 provided orthogonally on the collar 56. It should be understood that these flat faces 106 are primarily intended to provide a mechanical formation for a spanner to hold the drive sub 12E while it is being attached to the reamer sub 32. It is for this reason that the flat faces 106 are orientated parallel to the axis of rotation of the drive sub 12E. The flat faces 16 are not equivalent to the channel 86.

Figure 13:
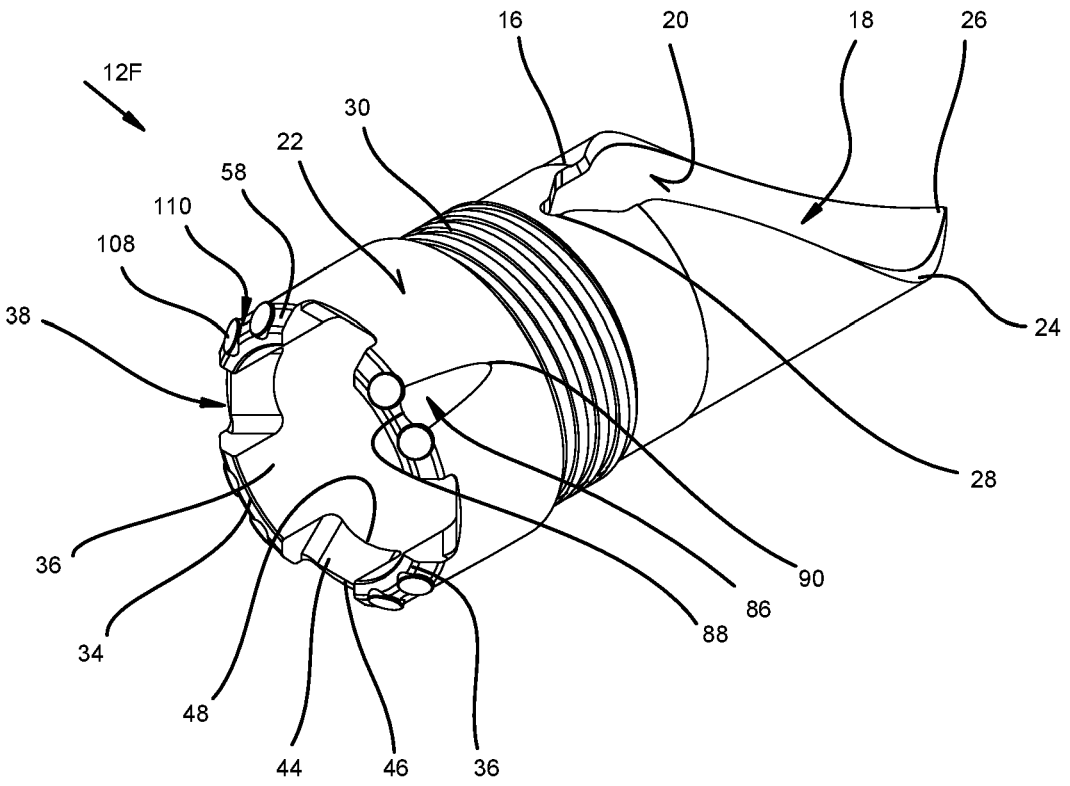
FIG. 13 is a perspective view of a sixth embodiment of a drive sub.
Figure 14:
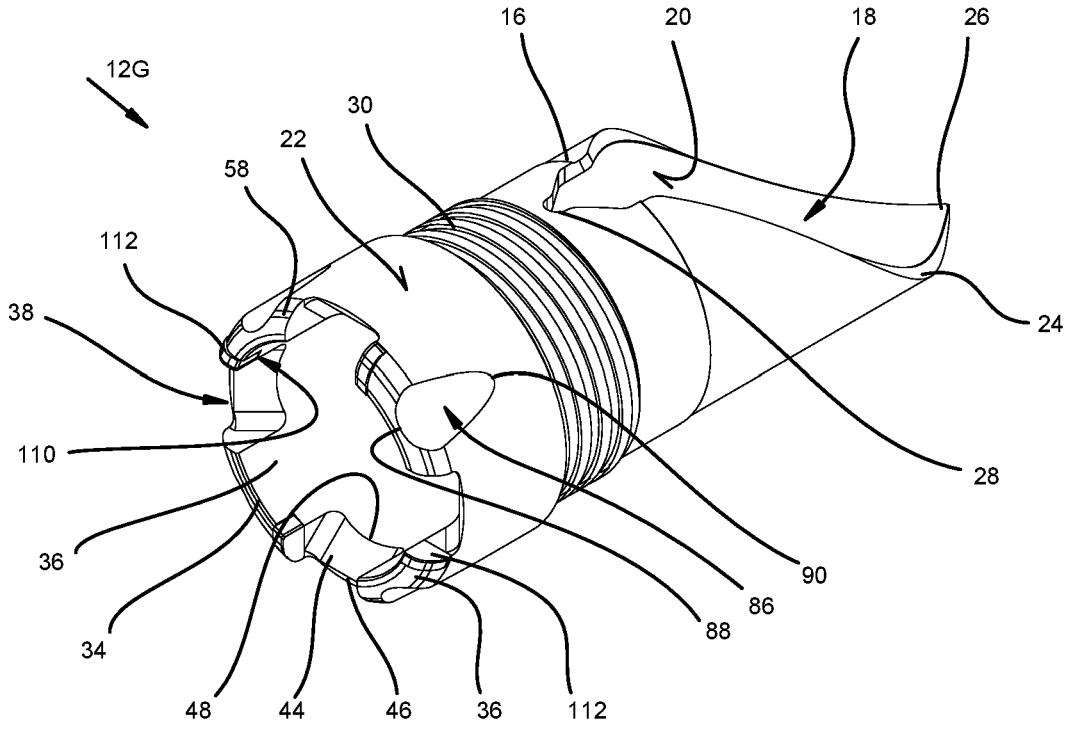
FIG. 14 is a perspective view of a seventh embodiment of a drive sub.

Referring now to FIGS. 13 and 14, there are respectively shown a sixth and a seventh embodiment of a drive sub 12F and 12G. The drive subs 12F,12G are roughly similar to the drive subs 12 and 12C and thus the same parts will be identified using the same reference numerals. The drive subs 12F, 12G are provided with only the first part 52 of the contour profile 50 seen on drive sub 12, namely they only have the chamfer face 58 and fillet faces 60,62 leading from the edge 34 onto the outer face 22 (i.e. leading up to shoulder 56, but not displaying the circumferential recess 64). Further, the drive subs 12F,12G are provided with channels 86 in their lugs 36 similar to those seen in drive sub 12C, each channel 86 having an inlet opening 88 leading from the edge 34 and an outlet opening 90 exiting on the outer face 22.

The drive sub 12F is provided with wear-resistant members such as a number of polycrystalline diamond ("PCD") buttons 108 on its lugs 36. The PCD buttons 108 are mounted in recesses 110 provided on the edge 34 and/or in the first part 52 of the contour profile 50. Each lug 36 has a pair of the PCD buttons 108, with one PCD button 108 being located on either side of its channel 86.

The drive sub 12G illustrates examples of different wear-resistant members such as polycrystalline diamond ("PCD") blades 112 on its lugs 36. The PCD blades 112 are mounted in recesses 114 in the lugs 36 so that the blades 112 lie adjacent to and are open to the slots 38. The PCD blades 112 are located on a rotationally leading part of the lugs 36.

It will be appreciated that the wear resistant members (the PCD buttons 108 and/or blades 112) can be provided on any of the other embodiments of the drive sub 12-12E.

In some embodiments the respective drive subs 12-12G can be configured to have wear resistant members comprising both the PCD buttons 108 and the blades 112.

In some embodiments the PCD buttons 108 and blades 112 have an external axial downhole face lying flush with the edge 34 and/or first part 52, but in other embodiments the PCD buttons 108 and blades 112 can sit proud of the edge 34 and/or first part 52. The PCD buttons 108 and blades 112 are configured to be more resistant to wear than the edge 34 of the drive sub 12F,12G.

During use, the PCD buttons 108 and/or blades 112 are configured to protect the edge 34 of the drive sub 12F,12G when the drill string is operated without the tool 14 being present or properly engaged within the drive sub 12F,12G, i.e. when the tool 14 is delivered to and received within the drive sub 12G,12F but the locking members 40 fail to align properly with the slots 38 thereby preventing the locking members 40 from latching between the lugs 32. The PCD buttons 108 and/or blades 112 thereby act as a temporary substitute for the reamer pads 42 and abut against the ledge present in the borehole caused by the step change in the borehole diameter. Once the tool 14 has been withdrawn from the drill string, inspected and repaired, and again lowered to properly latch with the drive sub 12F,12G, so that the reamer pads 42 projected downhole of the edge 34, then the PCD buttons 108 and blades 112 will be spaced from the ledge present within the borehole and do not partake in the drilling operations.

In other embodiments, the wear resistant members (the PCD buttons 108 and/or blades 112) can be omitted and substituted by providing a wear-resistant coating provided at least on the edge 34 and/or on the first part 52. In some instances, the wear-resistant coating can be provided over the entire outer surface of the drive sub. In yet other embodiments, a combination of both the wear resistant members and the wear-resistant coating can be used on the drive sub. Typically, the wear-resistant coating will comprise a metal alloy, such as a tungsten carbide based alloy.

It will be appreciated by persons skilled in the art that numerous variations and/or modifications may be made to the drive sub as shown in the specific embodiments without departing from the spirit or scope of the disclosure as broadly described. The present embodiments are, therefore, to be considered in all respects as illustrative and not restrictive.

In the claims which follow and in the preceding description, except where the context requires otherwise due to express language or necessary implication, the word "comprise" or variations such as "comprises" or "comprising" is used in a non-limiting and an inclusive sense, i.e. to specify the presence of the stated features but not to preclude the presence or addition of further features in the various embodiments of the drive sub. A reference to an element by the indefinite article "a" does not exclude the possibility that more than one of the elements is present, unless the context clearly requires that there be one and only one of the elements.

The invention claimed is:

1. A drive sub for a drilling assembly, the drive sub comprising a tubular body configured to receive and releasably engage a tool, the body having an inner face and an outer face;

a castellated edge provided at an operative downhole end of the body, the castellated edge defining a plurality of lugs separated from each other by intervening slots; and a contour profile provided at least partially along a circumference of the castellated edge, the contour profile traversing the castellated edge substantially from the inner face to the outer face, wherein the contour profile is configured to facilitate flow of drilling fluid and cuttings past the lugs during use, wherein each of the lugs includes a channel at least partially traversing the contour profile.

2. The drive sub as claimed in claim 1, wherein the contour profile is disposed on the lugs to form a radial ramp being configured in use to deflect flow of drilling fluid and cuttings from a vicinity near the inner face towards the outer face.

3. The drive sub as claimed in claim 1, wherein the contour profile comprises a chamfer face between the castellated edge and the outer face.

4. The drive sub as claimed in claim 3, wherein the contour profile comprises respective fillets between the chamfer face and the inner face and between the chamfer face and the outer face.

5. The drive sub as claimed in claim 1, wherein the contour profile comprises a bevelled face extending from the inner face to the outer face.

6. The drive sub as claimed in claim 1, wherein the contour profile further comprises a circumferential recess in the outer face, the recess being disposed in a region of the outer face located operatively uphole of the lugs.

7. The drive sub as claimed in claim 6, wherein the recess is substantially non-symmetrically V-shaped in cross-sectional side view comprising a downhole radial wall and an uphole radial wall, wherein the downhole radial wall has a greater transverse inclination than the uphole radial wall.

8. The drive sub as claimed in claim 6, wherein during use the contour profile is configured to cooperate with a borehole sidewall to define a venturi formation adjacent the body, the venturi formation being adapted to cause increased flow rates in drilling fluid as it flows axially over the contour profile.

9. The drive sub as claimed in claim 1, wherein each lug has a leading part and a trailing part with reference to a direction of rotation of the body during use, wherein the leading part is configured to provide support to a locking member located in a slot adjacent the leading part and wherein the channel is located substantially in the trailing part.

10. The drive sub as claimed in claim 9, wherein each channel is contiguous with a slot adjacent the trailing part.

11. The drive sub as claimed in claim 1, wherein each channel is open to the outer face along a full extent of the channel and the channel extends at its downhole end from substantially near to the inner face and leads at its uphole end onto the outer face of the body.

12. The drive sub as claimed in claim 1, further comprising wear-resistant members mounted on the lugs.

13. The drive sub as claimed in claim 12, wherein the wear-resistant members comprise polycrystalline diamond buttons and/or blades mounted in recesses, which recesses are selectively provided to the lugs, or to the castellated edge, or to a downhole facing part of the contour profile.

14. The drive sub as claimed in claim 1, further comprising a wear-resistant coating provided on the lugs.

15. A drilling assembly comprising a drive sub as claimed in claim 1; and a tool supported by the drive sub, the tool comprising one or more gullies in its outer circumference, wherein the gullies are configured to selectively cooperate with either one of or both the contour profile and the channel to respectively direct flow of drilling fluid over the contour profile or into the channel and thereby assist in facilitating flow of drilling fluid and cuttings past the lugs during use.

16. A drive sub for a drilling assembly, the drive sub comprising a tubular body configured to receive and releasably engage a tool, the body having an inner face and an outer face;

a castellated edge provided at an operative downhole end of the body, the castellated edge defining a plurality of lugs separated from each other by intervening slots; and a channel provided in each of the lugs, the channel at least partially traversing the lugs and leading from an inlet opening on the castellated edge to an outlet opening on the outer face, wherein each channel is open to the outer face along a full extent of the channel and the channel extends at its downhole end from substantially near to the inner face and leads at its uphole end onto the outer face of the body.

17. The drive sub as claimed in claim 16, wherein each lug has a leading part and a trailing part with reference to a direction of rotation of the body during use, wherein the leading part is configured to provide support to a locking member located in a slot adjacent the leading part and wherein the channel is located substantially in the trailing part.

18. The drive sub as claimed in claim 17, wherein each channel is contiguous with a slot adjacent the trailing part.

19. A drilling assembly comprising a drive sub as claimed in claim 16; and a tool supported by the drive sub, the tool comprising one or more gullies in its outer circumference, wherein the gullies are configured to selectively cooperate with either one of or both the contour profile and the channel to respectively direct flow of drilling fluid over the contour profile or into the channel and thereby assist in facilitating flow of drilling fluid and cuttings past the lugs during use.

* * * * *